US005539147A

United States Patent [19]

Hoshino

[11] Patent Number: 5,539,147

[45] Date of Patent: Jul. 23, 1996

[54] GUITAR PICKUP STRUCTURE USING VIBRATION TRANSMITTING BARS

[75] Inventor: Yoshiki Hoshino, Aichi-ken, Japan

[73] Assignee: Hoshino Gakki Co., Ltd., Japan

[21] Appl. No.: 390,630

[22] Filed: Feb. 17, 1995

[30] Foreign Application Priority Data

Oct. 11, 1994 [JP] Japan ..... 6-272962

[51] Int. Cl.[6] ..... G10H 3/00

[52] U.S. Cl. ..... 84/723; 84/731

[58] Field of Search ..... 84/723, 730, 731, 84/DIG. 24

[56] References Cited

U.S. PATENT DOCUMENTS 4,242,938 1/1981 Zalinge ..... 84/731
4,632,002 12/1986 Clevinger ..... 84/731
5,078,041 1/1992 Schmued ..... 84/731
5,410,101 4/1995 Sakurai ..... 84/731

*Primary Examiner*—William M. Shoop, Jr.
*Assistant Examiner*—Jeffrey W. Donels
*Attorney, Agent, or Firm*—Ostrolenk, Faber, Gerb & Soffen

[57] ABSTRACT

A guitar pickup structure includes pickup elements which are arranged below the lower surface of a guitar string saddle that is provided on a guitar bridge. The bridge is installed on the top surface of the guitar. Vibrations of the strings are transmitted to the pickup elements through the saddle, for generating amplified sounds by means of the electric signals. Two vibration transmitting bars run through the bridge and the top surface of the guitar body and contact the lower side of the saddle. A pickup member, having two pickup elements which correspond to and engage the two vibration transmitting bars, is arranged beneath the guitar body top surface. The pickup member is fixed by means of an installation member or bolt arranged on the guitar bridge below the saddle.

9 Claims, 5 Drawing Sheets

FIG. 5
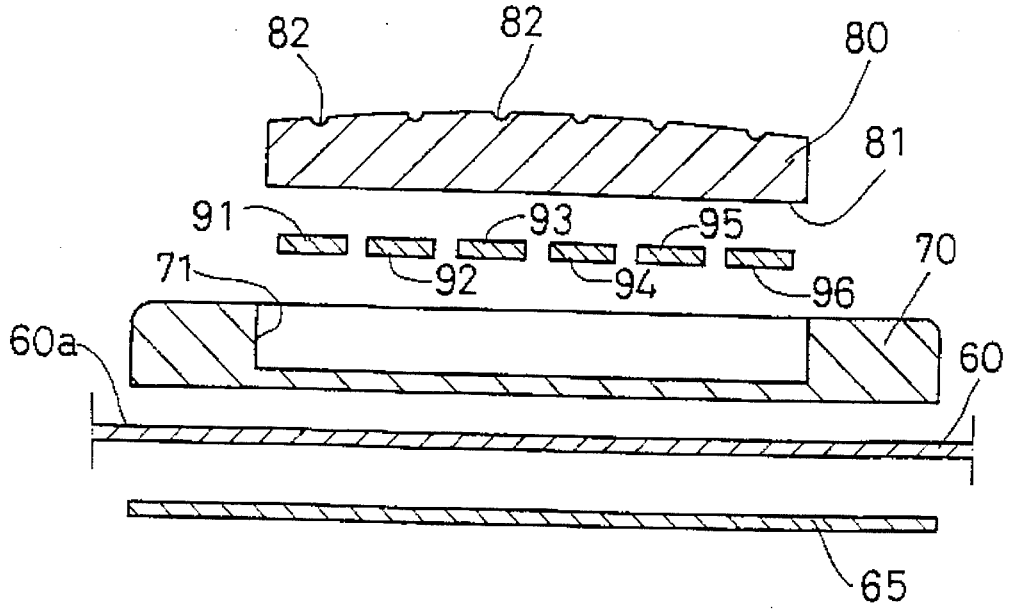
FIG. 6
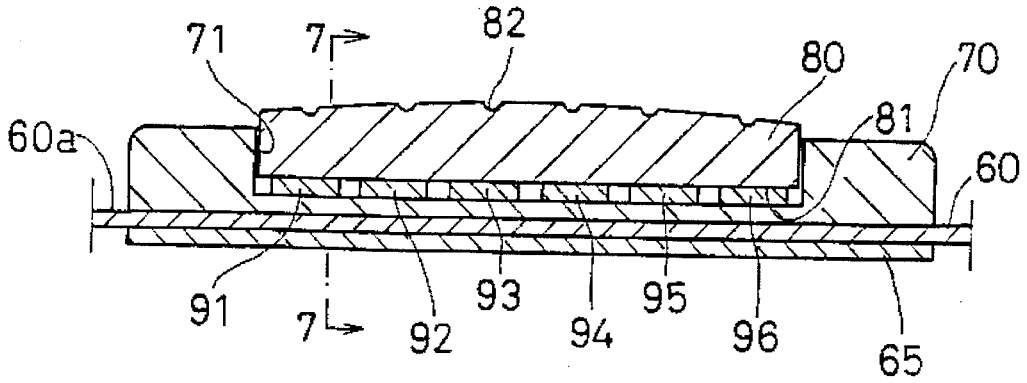
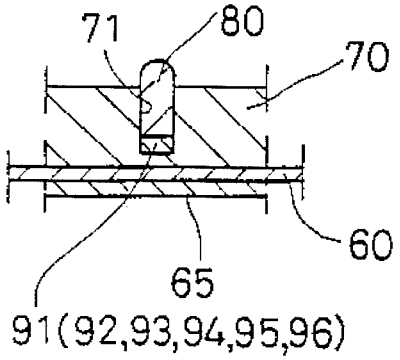
FIG. 7

GUITAR PICKUP STRUCTURE USING VIBRATION TRANSMITTING BARS

BACKGROUND OF THE INVENTION

This invention relates to the structure of a pickup for a guitar.

An electric guitar has a pickup for converting the mechanical vibrations of the strings (hereafter referred to as "vibrations") into electric vibrations (hereafter referred to as "electric signals"), and sound is generated from a speaker as the electric signals are amplified by means of an amplifier.

A pickup is constructed such that the vibrations of the strings are transmitted to the pickup element through a saddle, and the vibrations of the strings are converted into an electric signal by the pickup element. The pickup element is comprised of crystals of piezoelectric ceramic, quartz, tourmaline, rochelle salt, etc. The crystals are strained by the force that is applied to the crystals by the vibrations of the strings for generating either a positive or a negative electric potential difference, called piezoelectricity, at both poles.

DESCRIPTION OF THE PRIOR ART

An example of a prior art pickup structure is shown in FIGS. 5 through 7. Pickup elements 91, 92, 93, 94, 95 and 96 which correspond to the number of strings (six in this example) are arranged immediately below the strings (not shown) below the lower surface 81 of a saddle 80 that is installed in a saddle accommodation part or recess 71 of a bridge 70. The recess 71 is provided above the surface 60*a* of the table 60 or top side of a guitar. The pickup elements are held and fixed between the upper surface of the saddle accommodation recess 71 and the lower surface 81 of the saddle. A reverse plate 65 beneath the table 60 reinforces it. There is a string groove 82 in the top edge of the saddle 80 for each string.

The above described prior art structure is simple and its small number of parts make it easy for it to be assembled and installed. Because a plurality of small pickup elements which correspond to the strings are held and fixed between the upper surface of the saddle accommodating recess 71 and the lower surface 81 of the saddle, however, inconvenient tilting of the pickup elements often occurs, as illustrated in FIG. 8.

The pickup elements should be fixed as shown in FIG. 7. When the width in the guitar length direction of the saddle accommodation recess 71 becomes wider than its design value, due to a slight working error, etc., however, any of the pickup elements 91 (92, 93, 94, 95 or 96) becomes liable to incline (FIG. 8). It is possible for each pickup element to not be stably and firmly in contact with the saddle 80. As a result, the transmission of vibrations to each pickup becomes either unstable or incomplete and the sound volumes may differ among the different strings.

To cope with the above undesirable situation, a prior art structure which is shown in FIGS. 9 through 11 has been proposed. It includes a pickup member 140 having pickup elements 141, 142, 143, 144 145 and 146 erected on it at locations to correspond to those of the strings. The member 140 is formed on a base plate 148 which is arranged below the lower surface 131 of the saddle 130.

The table or top surface 120 of the guitar has a respective through hole 121 for receiving each pickup element and installation holes 122 through which securing bolts 160 pass. There is a bridge 125, which has a saddle accommodation part or recess 126, a respective through hole 127 for each pickup element, an installation hole 128 for each screw 160 and a string groove 132 on the top edge for each string. The pickup member 140 includes a respective screw hole 149 which receives the screw threaded end of each screw 160. A back plate 150 beneath the table 120 is for reinforcement. The plate 150 includes a respective through hole 151 for each pickup element and an installation hole 152 for each screw 160. An installation bolt or screw 160 extends through the bridge 125, table 120, plate 150 and into member 140 to secure those elements together.

With this structure, each pickup element that has been erected in the base plate 148 of the pickup member is accurately fixed below the side of the lower surface 131 of the saddle. As a result, there should be no tilting of the pickup elements, as has been described earlier. However, with this structure, the accuracy of the height dimension of each pickup element and the planar accuracy of the lower surface of the saddle are strictly required in view of the fact that each pickup element corresponds to one string.

In other words, if there were variations in the height dimensions of the pickup elements 141, 142, 143, 144, 145 and 146, as shown in FIG. 12, the lower surface 131 of the saddle may not contact all of the pickup elements 142, 143, 144 and 145 even though it may contact the two highest pickup elements 141 and 146.

On the other hand, if the plane of the saddle lower surface 131 is not smooth, then even if the height dimensions of the pickup elements may all be the same as shown in FIG. 13, some of the pickup elements 142, 143, 144 and 145 cannot contact the saddle lower surface 131. A similar problem occurs where the planar accuracy of the base plate 148 below the pickup elements is not sufficient.

In the two above described cases, the contact between each pickup element and the saddle 130 is imperfect. This produces a problem because the vibrations of the strings are not transmitted accurately and stably, and the sound volumes vary for different strings.

SUMMARY OF THE INVENTION

The object of the invention is to provide a guitar pickup structure which is capable of accurately transmitting the vibrations of the saddle to the pickup elements and which is extremely useful in its operation and installation even in the case where the dimensional accuracy of the pickup elements and the saddle, etc. may not be perfect.

In the invention, a guitar pickup structure includes pickup elements which are arranged below the lower surface of a guitar string saddle that is provided on a guitar bridge. The bridge is installed on the top surface of the guitar. Vibrations of the strings are transmitted to the pickup elements through the saddle, for generating amplified sounds by means of the electric signals. Two vibration transmitting bars run through the bridge and the top surface of the guitar body and contact the lower side of the saddle. A pickup member, having two pickup elements which correspond to and engage the two vibration transmitting bars, is arranged beneath the underside of the guitar body top surface. The pickup member is fixed by means of an installation member or bolt arranged on the guitar bridge below the saddle.

Other objects and features of the invention are explained below with reference to the attached drawings.

BRIEF DESCRIPTION OF THE DRAWINGS

FIG. 5 is an exploded cross sectional view of a pickup structure according to prior art.

FIG. 6 is a cross sectional view showing the state of installation of the prior art structure.

FIG. 7 is a cross section cut along line 7—7 in FIG. 6.

DESCRIPTION OF THE PREFERRED EMBODIMENT

Figure 1:
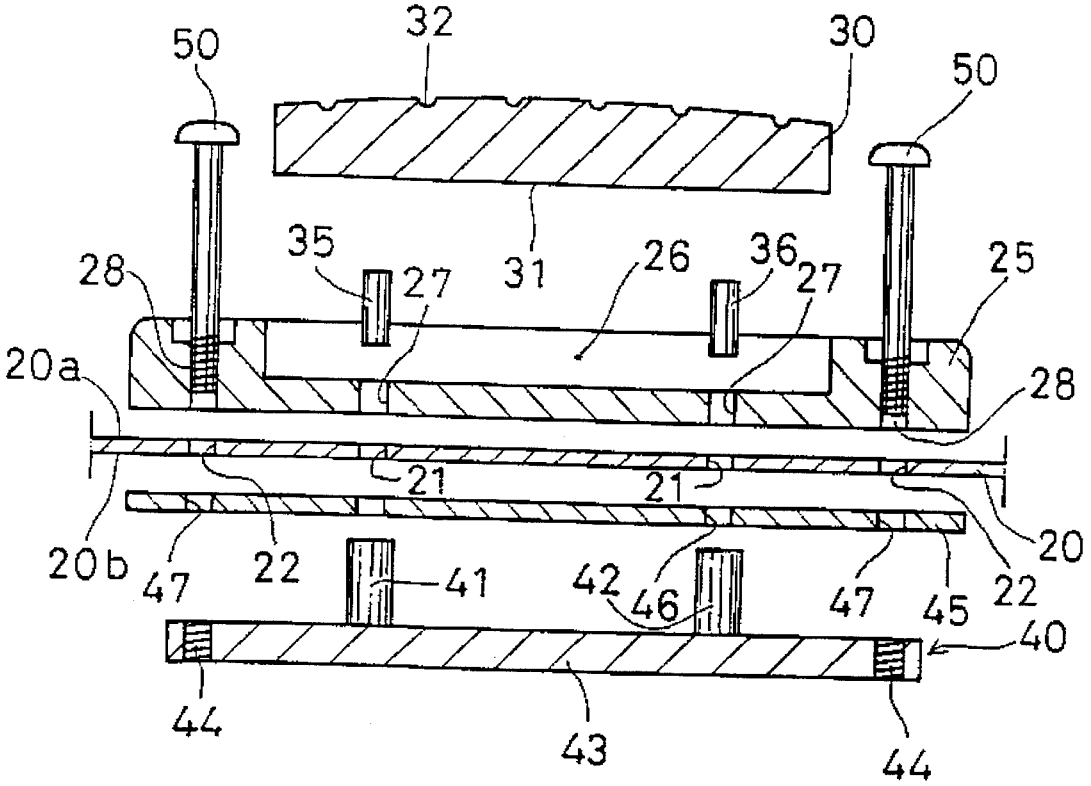
FIG. 1 is an exploded cross sectional view showing each part of an example of a pickup structure of a guitar according to the invention.
Figure 2:
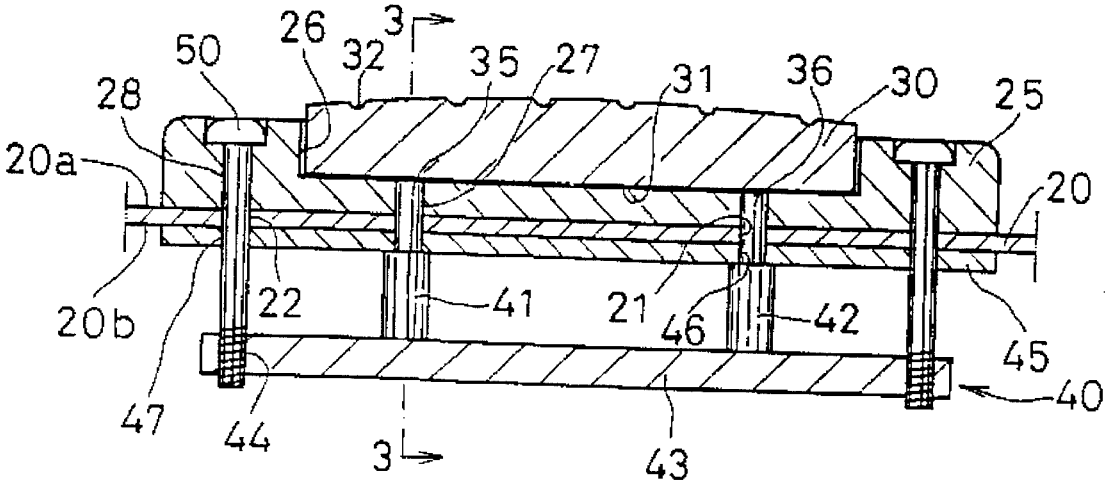
FIG. 2 is a cross sectional view showing the state of installation of the parts of the pickup structure.
Figure 3:
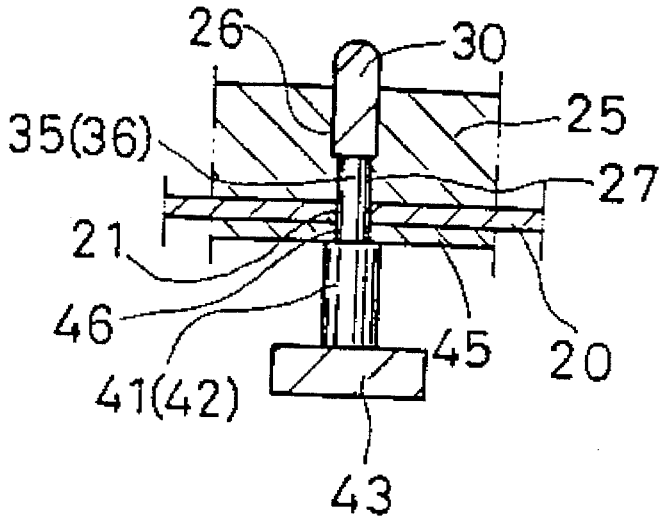
FIG. 3 is a cross section cut along line 3—3 in FIG. 2.

This invention relates to a guitar pickup structure including pickup elements 41 and 42 that are arranged below the side of the lower surface 31 of a saddle 30 that is installed in the saddle accommodation part 26 or recess of a bridge 25. That bridge is provided on the outward surface 20*a* of the top side or table 20 of the guitar. The vibrations of the guitar strings are transmitted to the pickup elements 41 and 42 through the saddle 30 which generates amplified sound by means of an electric signal, as is shown in FIGS. 1 and 2. There is a string groove 32 on the top edge of the saddle for each string. The pickup member 40 is provided at the reverse or bottom face of the table 20.

Two vibration transmitting bars 35 and 36 are arranged at the lower surface 31 of the saddle 30. The vibration transmitting bars 35 and 36 below the lower saddle surface 31 run through the through holes 21 in the table 20 and through the through holes 27 in the bridge 25. The bars transmit the vibrations of the strings, that have been transmitted to the bars by the saddle 30, to the pickup elements 41 and 42. A preferred material for the bars 35, 36 is a metal having a vibration transmission ability.

The vibration transmitting bars 35 and 36 are of such length that, when they run through the bridge 25 and the table 20, one end of each bar may slightly protrude (by approximately 0.5 millimeters to one millimeter) below the underside 20*b* of the table 20. The bars are formed as finely as possible within the range where the vibration transmission is not hindered. In this example, the vibration transmitting bars 35 and 36 are formed as cylinders having a diameter which is approximately one half that of the pickup elements 41 and 42 in consideration of the workability and ease of installation.

A reverse plate 45 for reinforcement of the table or guitar top surface 20 is optionally installed at the backside 20*b* of the table 20. The vibration transmitting bars 35 and 36 also run through the through holes 46 of this reinforcing reverse plate 45. Further, the thickness of the plate 45 is selected so that one end of the bars slightly protrudes from the reinforcing back plate 45.

The pickup member 40 is prepared by erecting two pickup elements 41 and 42 that correspond to, are aligned below and extend up far enough to contact the two vibration transmitting bars 35 and 36 on the base plate 43 at the reverse face 20*b* of the table 20.

The pickup member 40 and the plate 45 are fixed to the table 20 by an installation member or bolt 50 provided on the bridge 25. The bolt 50 is inserted from the top side of the bridge 25, and runs through the installation hole 28 of the bridge 25, the installation hole 22 of the table 20, the installation hole 47 of the reinforcing back plate 45 and is screwed into a threaded screw hole 44 of the base plate 43, thereby tightly securing the bridge 25 and the base plate 43 together and to the table 20.

This tightening draws the pickup elements 41 and 42 on the base plate 43 into contact with the vibration transmitting bars 35 and 36 which protrude below the reinforcing back plate 45. The tightening further causes the vibration transmitting bars 35 and 36 to firmly contact the lower surface 31 of the saddle 30. This causes the contact between the saddle 30 and the two vibration transmitting bars 35 and 36 and between the vibration transmitting bars 35 and 36 and the two pickup elements 41 and 42 to become completely firm.

Figure 4:
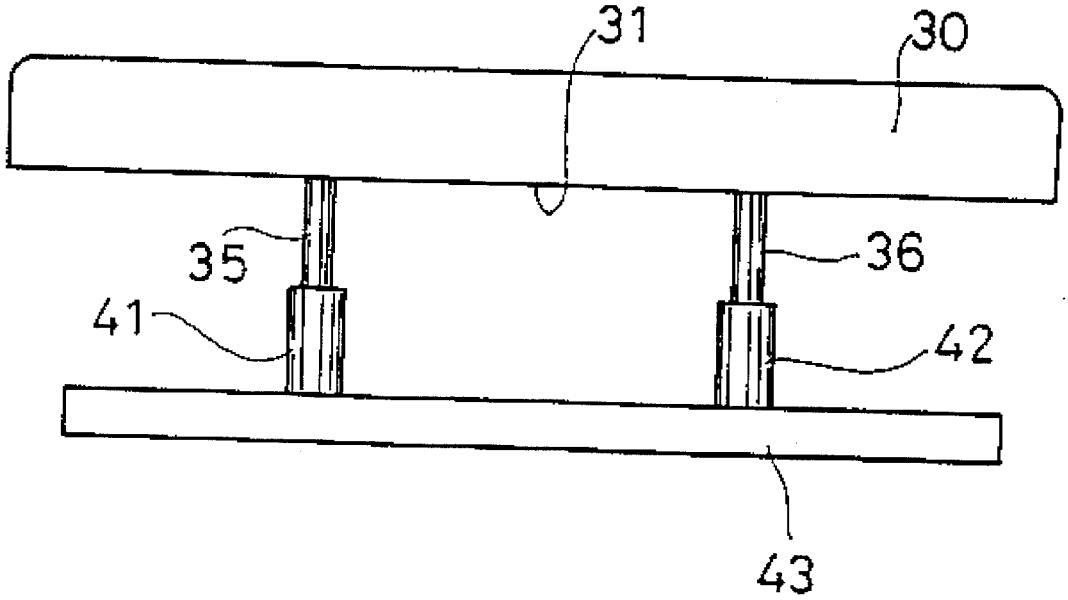
FIG. 4 is a conceptual drawing showing the pickup structure according to this invention.
Figure 8:
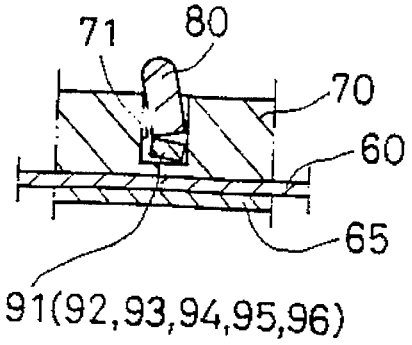
FIG. 8 is a cross sectional view showing the state in which the pickup element shown in FIG. 6 is tilted.
Figure 9:
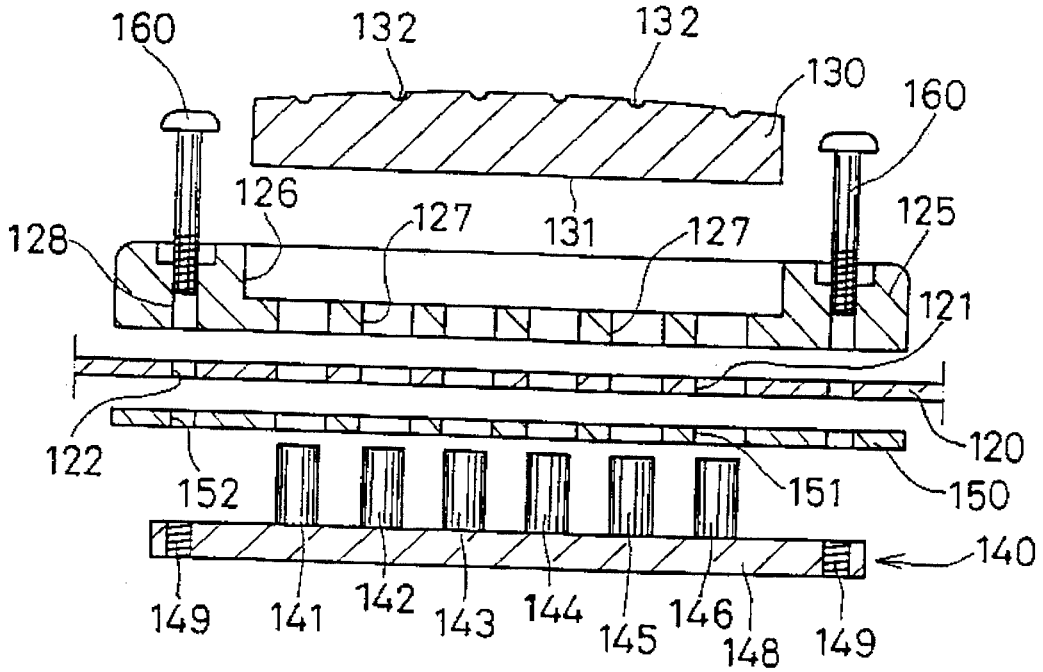
FIG. 9 is a cross sectional view showing another example of a pickup structure according to the prior art.
Figure 10:
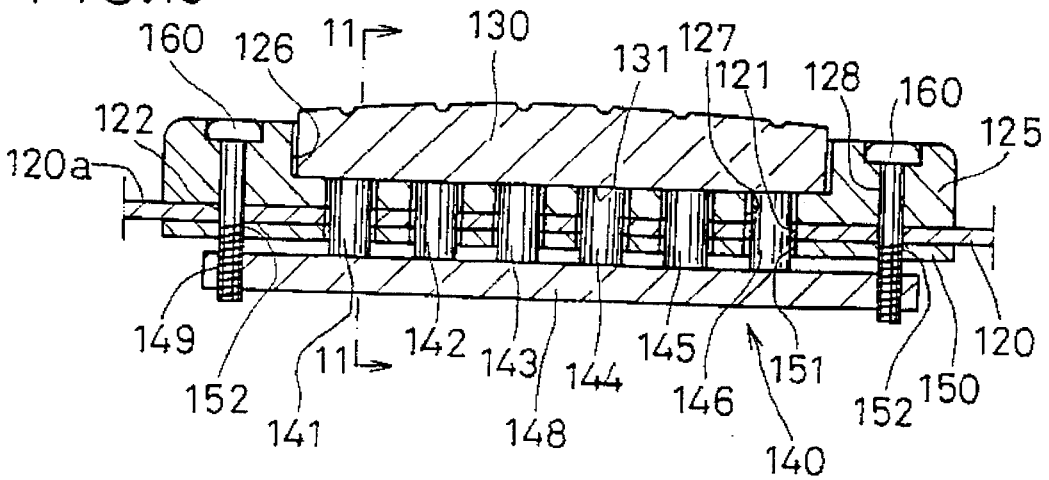
FIG. 10 is a cross section showing the state of installation of that pickup structure.
Figure 11:
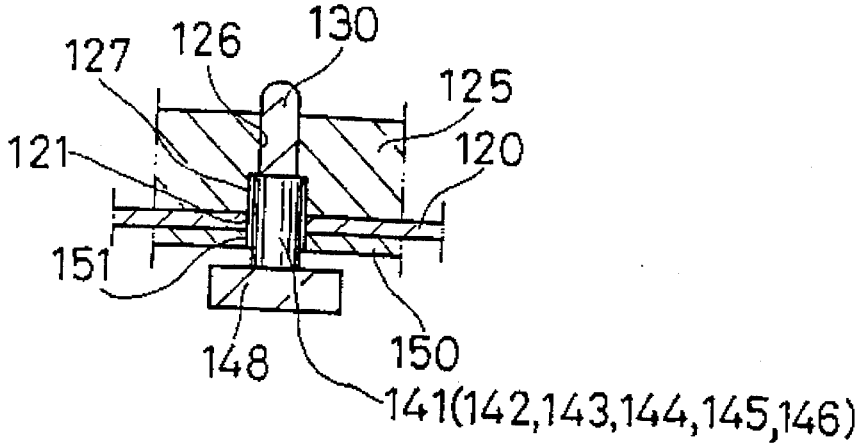
FIG. 11 is a cross section cut along line 11—11 in FIG. 10.
Figure 12:
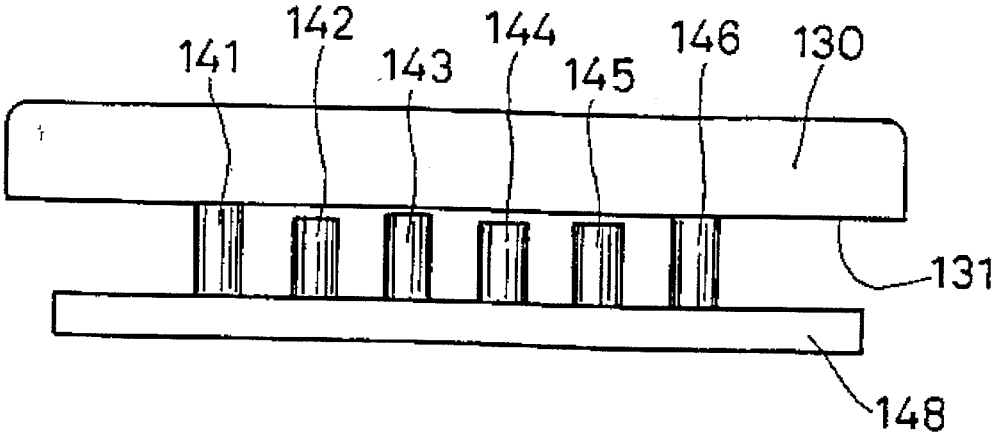
FIG. 12 is a conceptual drawing demonstrating the case where the accuracy of the pickup terminal is not perfect in the structure shown in FIG. 10.
Figure 13:
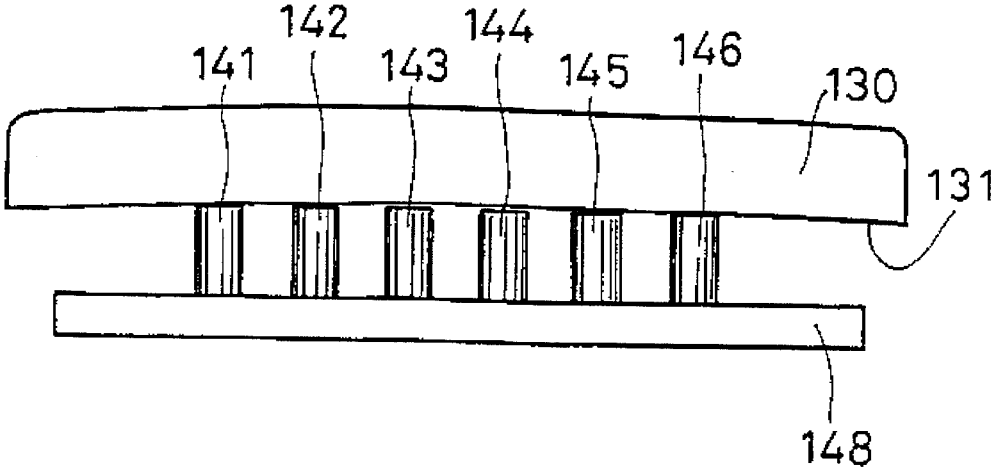
FIG. 13 conceptually shows the case where the accuracy of the saddle is not perfect in the structure shown in FIG. 10.

FIG. 4 illustrates this concept. Since two pickup elements 41, 42 are used in the pickup structure, contact with the saddle is effected stably. Furthermore, complete dimensional accuracy is not required of the pickup elements and the saddle, etc. in contrast with the prior art.

Possible disadvantages, like lowering of the sensitivity and the reduction of the sound volume, etc. stemming from employment of two pickup elements or at least fewer pickup elements than one for each string instead of using pickup elements corresponding to the various strings as in the prior art, have not been observed in an experiment. With regard to this, it is believed that satisfactory vibration transmission is obtained if ordinary saddle materials, like cow's bone or urea resin, etc. are used here.

The guitar pickup structure of the invention does not require that the pickup elements and the saddle, etc. have perfect dimensional accuracy. The vibrations of the saddle can be transmitted to the pickup elements stably and accurately, thereby contributing toward stabilization of the sound quality. In addition, both working and installation become much easier and the productivity is thereby improved.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A guitar pickup structure for an electric guitar wherein the electric guitar has a guitar body with a top surface, a bridge for the strings disposed on the top surface, and a saddle for the guitar strings supported on the bridge, the pickup structure comprising:

a saddle having a lower surface resting on the bridge and an upper surface on which guitar strings rest;

a pickup member disposed beneath the top surface of the guitar body and beneath the saddle, the pickup member having a plurality of pickup elements extending up from the pickup member and toward the bridge;

a respective vibration transmitting bar disposed above each of the pickup elements and in contact therewith and extending through the top surface of the guitar and through the bridge to contact the lower surface of the saddle such that vibration of the saddle caused by the strings is transmitted through the vibration transmitting bars to the respective pickup elements.

2. The guitar pickup structure of claim 1, wherein there are two of the pickup elements and two of the vibration transmitting bars, a respective bar for each of the pickup elements, and each of the vibration transmitting bars being of a length to engage the bottom side of the saddle and the respective pickup element.

3. The guitar pickup structure of claim 2, further comprising means for drawing the pickup member and the bridge toward each other and toward the top surface of the guitar body.

4. The guitar pickup structure of claim 3, wherein the bridge and the top surface of the guitar body have respective aligned holes therethrough for passage therethrough of the vibration transmitting bars and the holes being aligned with the respective pickup elements and with the lower side of the saddle, whereby vibration of the saddle is transmitted through the vibration transmitting bars to the pickup elements.

5. The guitar pickup structure of claim 4, further comprising a reinforcing plate disposed between the top surface of the guitar body and the pickup elements, the reinforcing plate having holes therein aligned with the holes through the guitar body permitting passage of the vibration transmitting bars therethrough and the vibration transmitting bars being of a length to extend between the pickup elements and the saddle.

6. The guitar pickup structure of claim 2, wherein the pickup elements extend up from the pickup member.

7. The guitar pickup structure of claim 2, wherein the bridge has a top side away from the top side of the guitar body, and a recess on the top side of the bridge shaped for accommodating the saddle therein.

8. The guitar pickup structure of claim 1, wherein the bridge and the top surface of the guitar body have respective aligned holes therethrough for passage therethrough of the vibration transmitting bars and the holes being aligned with the respective pickup elements and with the lower side of the saddle, whereby vibration of the saddle is transmitted through the vibration transmitting bars to the pickup elements.

9. The guitar pickup structure of claim 8, further comprising a reinforcing plate disposed between the top surface of the guitar body and the pickup elements, the reinforcing plate having holes therein aligned with the holes through the guitar body permitting passage of the vibration transmitting bars therethrough and the vibration transmitting bars being of a length to extend between the pickup elements and the saddle.

* * * * *